US009347248B2

(12) United States Patent
Ng

(10) Patent No.: US 9,347,248 B2
(45) Date of Patent: May 24, 2016

(54) BLIND HINGE STRUCTURE USED FOR FURNITURE

(71) Applicant: GUANGDONG TAIMING METAL PRODUCTS CO. LTD, Foshan, Guangdong (CN)

(72) Inventor: Tai Wai Ng, Foshan (CN)

(73) Assignee: GUANGDONG TAIMING METAL PRODUCTS CO. LTD., Foshan (CN)

( * ) Notice: Subject to any disclaimer, the term of this patent is extended or adjusted under 35 U.S.C. 154(b) by 0 days.

(21) Appl. No.: 14/286,845

(22) Filed: May 23, 2014

(65) Prior Publication Data

US 2015/0240543 A1 Aug. 27, 2015

(30) Foreign Application Priority Data

Feb. 24, 2014 (CN) ..... 2014 2 0078743 U

(51) Int. Cl.
*E05D 7/04* (2006.01)

(52) U.S. Cl.
CPC ..... *E05D 7/0407* (2013.01); *Y10T 16/529* (2015.01); *Y10T 16/5383* (2015.01)

(58) Field of Classification Search
CPC . Y10T 16/529; Y10T 16/532; Y10T 16/5321; Y10T 16/5322; Y10T 16/53225; Y10T 16/5324; Y10T 16/53247; Y10T 16/53253; Y10T 16/53257; Y10T 16/5383; Y10T 16/53832; Y10T 16/53833; Y10T 16/304; Y10T 16/5389; E05D 7/04; E05D 7/0407; E05D 7/0415; E05D 2007/0469; E05D 7/009; E05D 7/125; E05D 11/1014; E05D 11/1021; E05D 5/0276; E05F 3/02; E05F 5/006; E05Y 2900/20
USPC ..... 16/233, 235–238, 242, 243, 245, 24, 16/286–288, 50, 308; 312/326
See application file for complete search history.

(56) References Cited

U.S. PATENT DOCUMENTS

| | | | | | |
|---|---|---|---|---|---|
| 6,088,879 | A * | 7/2000 | Gasser | E05D 7/125 | 16/257 |
| 6,845,544 | B2 * | 1/2005 | Hofer | E05D 7/0415 | 16/242 |
| 6,918,158 | B2 * | 7/2005 | Isele | E05D 7/0415 | 16/235 |
| 7,516,516 | B2 * | 4/2009 | Wu | E05D 7/0415 | 16/238 |
| 7,653,967 | B2 * | 2/2010 | Lowe | E05D 7/0407 | 16/238 |
| 8,650,711 | B1 * | 2/2014 | Chen | E05F 5/006 | 16/286 |
| 2004/0163211 | A1 * | 8/2004 | Rucker | E05D 7/0415 | 16/235 |
| 2013/0167323 | A1 * | 7/2013 | Brunnmayr | E05D 11/1014 | 16/50 |
| 2014/0359973 | A1 * | 12/2014 | Ng | E05D 7/00 | 16/225 |
| 2014/0373309 | A1 * | 12/2014 | Ng | E05D 7/0407 | 16/308 |

* cited by examiner

*Primary Examiner* — William Miller
(74) *Attorney, Agent, or Firm* — Maier & Maier, PLLC

(57) ABSTRACT

A blind hinge structure used for furniture, comprising a movable cup seat provided on the furniture door body, a regulating base provided on the main body of furniture, a rotary arm connected between the movable cup seat and the regulating base, an elastic element which is designed to generate start-stop acting force on the movable cup seat at least, wherein the front of the rotary arm is designed as "卌" shaped structure, the arm lever at its small end is hinged with the movable cup seat through pin shaft and forms an arc-shaped surface which is connected with the elastic member; The top surface of its big end is a plane, and regulating components are provided on the plane and are in coordinated connection with the regulating base; fasteners are provided on the regulating base and are used in coordination with the regulating components for positioning.

6 Claims, 5 Drawing Sheets

BLIND HINGE STRUCTURE USED FOR FURNITURE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims the benefit of priority to Chinese Patent Application No. 201420078743.6, filed Feb. 24, 2014, of which full contents are incorporated herein by reference.

BACKGROUND

1. Field

The present utility model relates to a blind hinge structure used for furniture.

2. Description of the Related Art

On May 17, 2006, Chinese patent (patent number: CN2780937Y) disclosed a blind hinge for furniture door which can make regulation in three-dimensional direction, comprising a movable base which can be fixed on the door body, an adjustable base which can be fixed on the door frame and a rotary arm which is connected between the movable base and the adjustable base, wherein the adjustable base comprises a base plate which can be fixed on the door frame, a middle plate which is designed to slide up and down on the base plate and a upper regulating plate which is designed to slide forward or backward on the middle plate, that is to say, the base on the door frame is designed as three-layer plate structure; The plates are formed through alloy casting and then riveted with the lower-layer regulating plate through re-extrusion. Although the production process of this utility model is simple, this process brings hidden trouble to the quality of hinge. After the alloy casting has undergone re-extrusion, there are changes in the internal structure of such material, Description of Utility Model It is the technical objective of the present utility model to provide a blind hinge structure used for furniture, which is featured by simple and reasonable structure, low manufacturing cost, easy production and realization, compact connection between members, long service life, smooth process of opening/closing, low noise, esthetic appearance and good practicability, so as to overcome the deficiencies in the prior art.

A blind hinge used for furniture which is designed according to this technical objective, comprising a movable cup seat provided on the furniture door body, a regulating base provided on the main body of furniture, a regulating base provided on the main body of furniture, a rotary arm connected between the movable cup seat and the regulating base as well as an elastic element designed to generate start-stop acting force on the movable cup seat at least, characterized in that, the front of the rotary arm (2) is designed as similar "甲"-shaped structure, arm lever at its small end is hinged with the movable cup seat through pin shaft and forms an arc-shaped surface connected with the elastic element; the top surface at its big end is a plane, regulating components are provided on the plane and are in coordinated connection with the regulating base, fastener are provided on the regulating base and are in coordinated positioning with the regulating components.

The elastic element is a torsion spring, wherein two torsion springs are respectively mounted on the notches on both sides at the bottom of the movable cup seat; The torsion spring at least comprises a first supporting leg with one end extending into the cup body of the movable cup seat and being connected with it as well as a second supporting leg with another end acting on the movable cup seat, wherein the free end of the first supporting leg is bent, and at step is provided at the bottom wall of moveable cup seat correspondingly, and the second supporting leg is carried on the step.

A sleeve part is provided on the second supporting leg, the second supporting leg is in coordinated connection with the arc-shaped surface through the sleeve part; the sleeve part is in open sleeve form or closed sleeve form and is made from plastic or rubber.

The regulating base is a movable plate, the regulating components comprise regulating screw and eccentric regulating rivet; The rotary arm is connected with the movable plate through the regulating screw and the eccentric regulating rivet, so as to realize the two-dimensional regulation of the furniture door body; The fasteners are provided at the bottom of the movable plate and are in coordinated positioning with the eccentric regulating rivet.

An open slot is provided on the front end of the movable plate, a first regulating hole is provided on the rotary arm corresponding to the open slot, and both the open slot and the first regulating hole are in coordinated connection through the regulating screw; a hole is provided on the moveable plate, a second regulating hole is provided on the rotary arm corresponding to the hole, and both the hole and the second regulating hole are in coordinated connection through the eccentric regulating rivet.

Both sides of the rotary arm are bent downwards to form a slot which is in limiting connection with the movable plate, a boss is provided on the movable plate and is in coordinated connection with the rotary arm (2), and at least two angles of movable plate are bent downwards to form a claw.

The regulating base is composed of a movable plate and a base plate, where in the movable plate is positioned between the base plate and the rotary arm, the regulating components comprise one regulating screw and two eccentric regulating rivets; the rotary arm is connected with the movable plate through the regulating screw and the first eccentric regulating rivet; The movable plate is connected with the base plate through the second eccentric regulating rivet, so as to realize the three-dimensional regulation to the furniture door body; The fasteners are provided at the bottom of the base plate and are in coordinated positioning with the first eccentric regulating rivet and/or the second eccentric regulating rivet.

The regulating screw, the first eccentric regulating rivet and the second eccentric regulating rivet are in triple-lapped arrangement; An open slot is provided on the front end of the movable plate, a first regulating hole is provided on the rotary arm corresponding to the open slot, and both the open slot and the first regulating hole are in coordinated connection through the regulating screw; A hole is provided on the movable plate, a second regulating hole is provided on the rotary arm corresponding to the hole, and both the hole and the second regulating hole are in coordinated connection through the first eccentric regulating rivet; Another hole is also provided on the movable plate, a matching hole is provided on the base plate corresponding to the hole, and both the hole and the matching hole are in coordinated connection through the second eccentric regulating rivet.

Both sides of the rotary arm are bent downwards to form a slot which is in limiting connection with the movable plate, a boss is provided on the movable plate (3) and is in coordinated connection with the rotary arm; the outside of the base plate is bent towards the direction of movable plate and forms a guide slot, the movable plate is slideably provided on the guide slot, and at least two angles of the base plate are bent downwards to form a blocking part.

Both the rotary arm and the regulating base are molded by integrated stamping and bending of metal.

Through the improvement of the said structure according to the present utility model, the front of the rotary arm is designed as "甲" shaped structure, the arm level at its small end is hinged with the movable cup seat through pin shaft, the top surface at its big end is a plane, regulating components are provided on the plane and are in coordinated connection with the regulating base, so thon the production process is simplified. In addition, fasteners provided on the regulating base are in coordinated positioning with the regulating components, so thon the structure among the rotary arm, the regulating base and the regulating components has even higher firmness, even compact assembly can be realized and thus the structural strength and service life of the blind hinge used for furniture are improved. The elastic component is directly provided on the notch of the movable cup seat without need for any component, so thon the manufacturing process is further simplified and thus the manufacturing cost is reduced. Furthermore, a sleeve part is also provided on the elastic member to effectively reduce the friction between the elastic member and the movable cup seat in opening/closing of hinge, the loss of elastic element and the noise generated due to the friction between the elastic member and the movable cup seat, so thon the opening/closing of hinge is more smooth and less noise is generated. The present utility model is featured by simple and reasonable structure, reliable performance, low manufacturing cost, easy production and realization, compact connection between members, long service life, smooth opening/closing process, low noise, esthetic appearance and good practicability.

DESCRIPTION OF ATTACHED DRAWINGS

Figure 1:
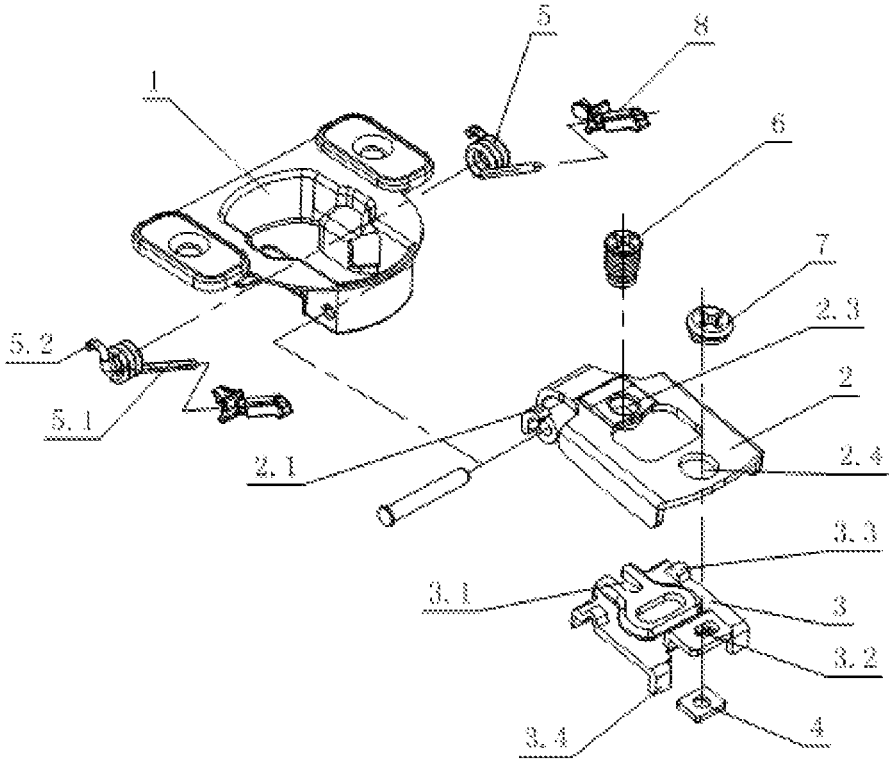
FIG. 1 is the breakdown structure diagram of an embodiment of the present utility model.
Figure 2:
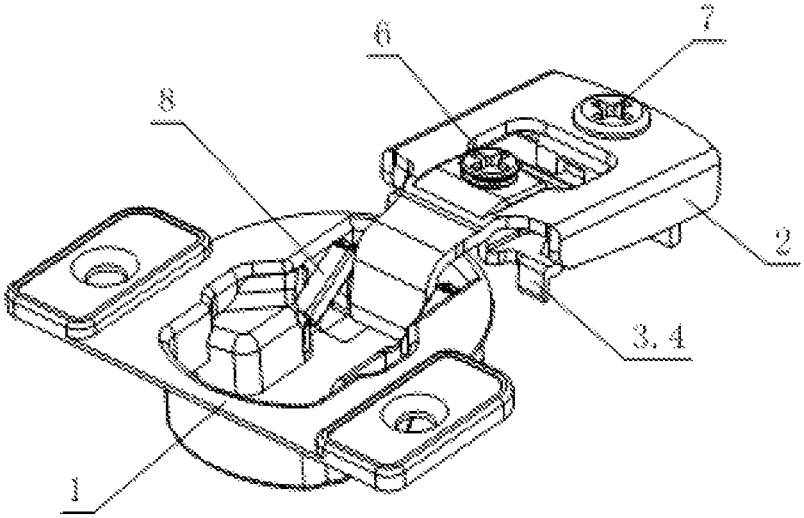
FIG. 2 is the structure diagram of the combined state of FIG. 1.
Figure 3:
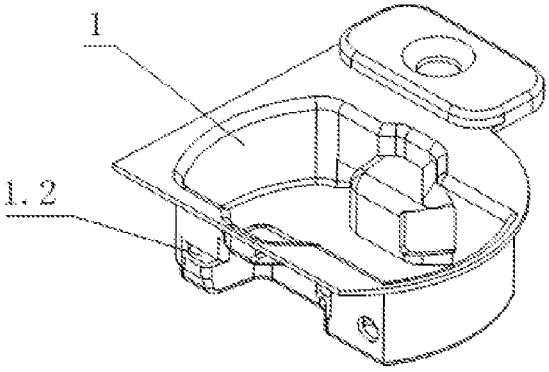
FIG. 3 is the structure diagram of the movable cup seat in an embodiment.
Figure 4:
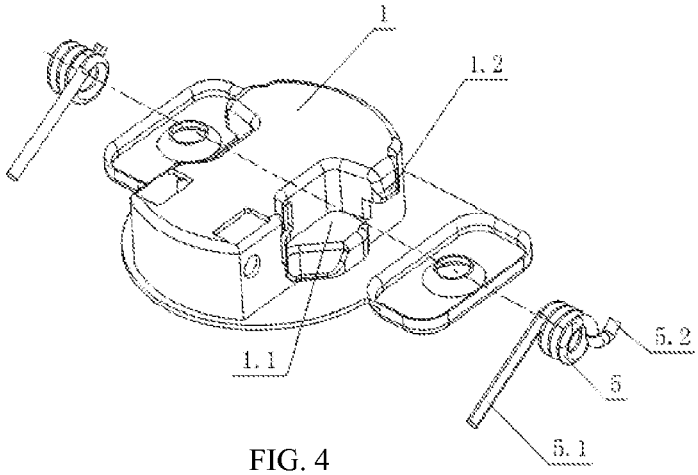
Figure 5:
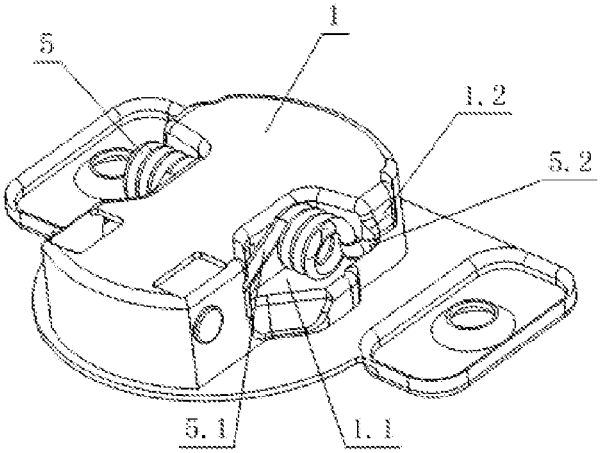

FIG. 4 and FIG. 5 provide the schematic diagram of the connection structure between the movable cup seat and the elastic element in an embodiment.

Figure 6:
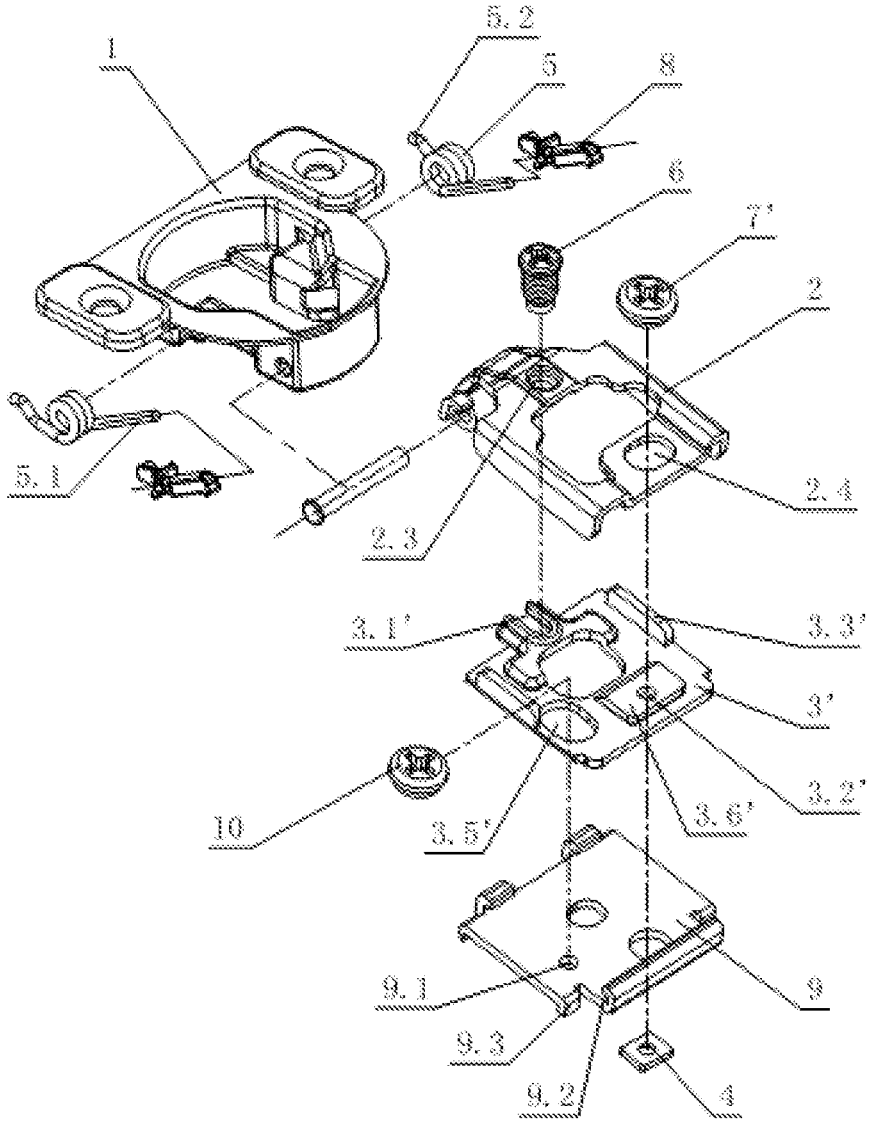

FIG. 6 is the breakdown structure diagram of the second embodiment of the present utility model.

Figure 7:
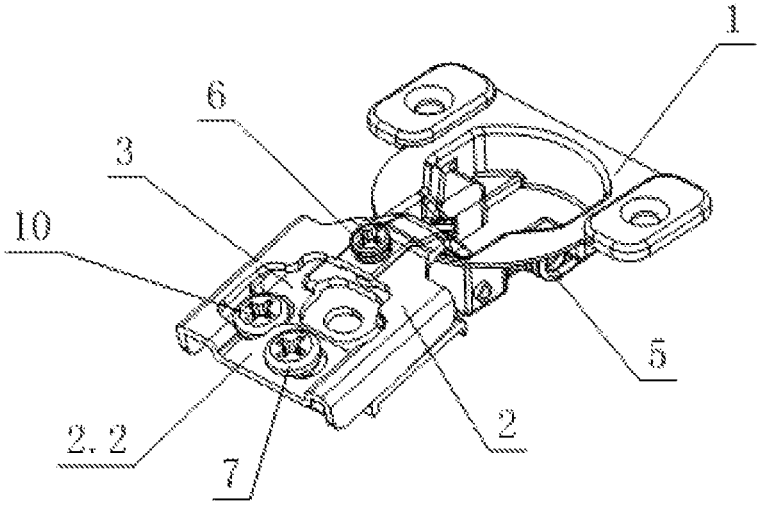

FIG. 7 is the structure diagram of the combined state of FIG. 6.

Figure 8:
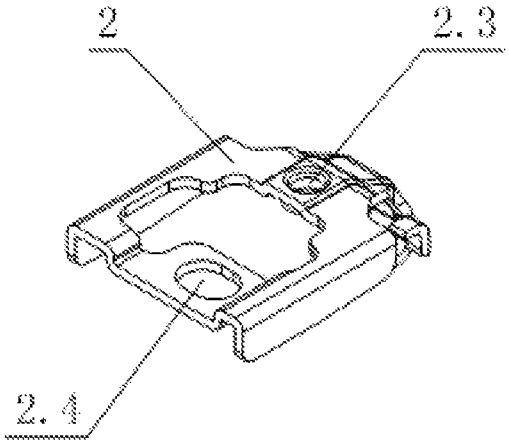
Figure 9:
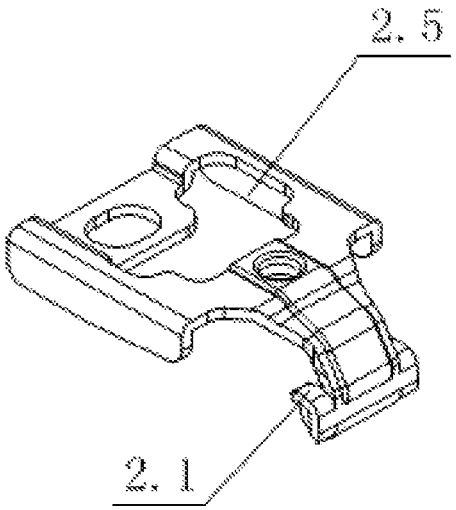

FIG. 8 and FIG. 9 provide the structure diagram of the rotary arm in the second embodiment.

Figure 10:
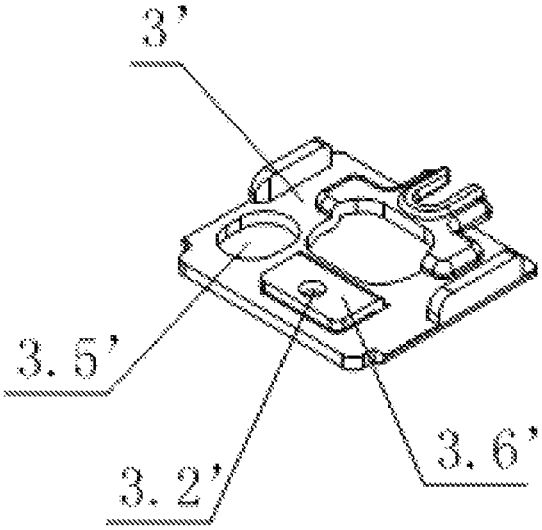

FIG. 10 is the structure diagram of the movable plate in the second embodiment.

DETAILED DESCRIPTION OF PREFERRED EMBODIMENTS

Further detailed description of the present utility model is provided with reference to specific embodiments in combination with attached drawings.

The First Embodiment

With reference to FIGS. 1-5, A blind hinge used for furniture which is designed according to this technical objective, comprising a movable cup seat 1 provided on the furniture door body, a regulating base provided on the main body of furniture, a rotary arm 2 connected between the movable cup seat 1 and the regulating base as well as an elastic element designed to generate start-stop acting force on the movable cup seat 1 at least, wherein the front of the rotary arm (2) is designed as similar "甲"-shaped structure, the arm lever at its small end is hinged with the movable cup seat 1 through a pin shaft and forms an arc-shaped surface 2.1 connected with the elastic element; The top surface at its big end is a plane, regulating components are provided on the plane and are in coordinated connection with the regulating base, fasteners 4 are provided on the regulating base and are in coordinated positioning with the regulating components.

Specifically, the elastic element is a torsion spring (5), wherein two torsion springs are respectively mounted on the notches (1.1) on both sides at the bottom of the movable cup seat 1; The torsion spring (5) at least comprises a first supporting leg (5.1) with one end extending into the cup body of the movable cup seat 1 and being connected with the arc-shaped surface 2.1 as well as a second supporting leg 5.2 with another end acting on the movable cup seat 1, wherein the free end of the second supporting leg 5.2 is bent, a step 1.2 is provided at the bottom wall of the movable cup seat (1) correspondingly, and the second supporting leg (5.2) is carried on the step (1.2); A sleeve part 8 is provided on the second supporting leg 5.2, and the second supporting leg 5.1 is in coordinated connection with the arc-shaped surface 2.1 through the sleeve part 8; The sleeve part 8 is in open sleeve form or closed sleeve form and is made from plastic or rubber.

In said structure, the regulating base is a moveable plate 3, the regulating components comprise a regulating screw 6 and an eccentric regulating rivet 7; The rotary arm 2 is connected with the movable plate 3 through the regulating screw 6 and the eccentric regulating rivet 7, so as to realize the two-dimensional regulation to the furniture door body; The fasteners 4 are provided at the bottom of the movable plate and are in coordinated positioning with the eccentric regulating rivet 7.

Specifically, an open slot 3.1 is provided on the front end of the movable plate 3, a first regulating hole 2.3 is provided on the rotary arm 2 corresponding to the open slot 3.1, and both the open slot 3.1 and the first regulating hole 2.3 are in coordinated connection through the regulating screw 6; A hole 3.2 is provided on the movable plate 3, and a second regulating hole 2.4 is provided on the rotary arm 2 corresponding to the hole 3.2, and both the hole 3.2 and the second regulating hole 2.4 are in coordinated connection through the eccentric regulating rivet 7. In order thon the connection and regulation between the rotary arm 2 and the movable plate 3 are more reasonable, both sides of the rotary arm 2 are bent downwards to form a slot 2.5 which is in limiting connection with the movable plate 3, a boss 3.3 is provided on the movable plate 3 and is in coordinated connection with the rotary arm 2, wherein at least two corners of the movable plate 3 are bent downwards to form a claw 3.4, which is embedded in the main body frame of furniture to realize the positioning of the movable plate 3.

Both the rotary arm 2 and the movable plate 3 are molded by integrated stamping and bending of metal.

The Second Embodiment

With reference to FIGS. 5-10, The present blind hinge structure used for furniture differs from the first embodiment in the following aspects: The regulating base is composed of a movable plate 3' and a base plate 9, the movable plate 3' is positioned between the base plate 9 and the rotary arm 2, the regulating components comprise one regulating screw and two eccentric regulating rivet; the rotary arm 2 is connected with the movable plate 3' through the regulating screw 6 and the first eccentric regulating rivet 7', the movable plate 3' is connected with the base plate 9 through the second eccentric regulating rivet 10, so as to realize the three-dimensional regulation to the furniture door body; The fasteners 4 are provided at the bottom of the base plate 9 and are in coordinated positioning with the first eccentric regulating rivet 7' and/or the second eccentric regulating rivet 10.

Specifically, the regulating screw 6, the first eccentric regulating rivet 7' and the second eccentric regulating rivet 10 are in triple-lapped arrangement; An open slot 3.1' is provided on the front end of the movable plate 3', a first regulating hole 2.3 is provided on the rotary arm 2 corresponding to the open slot 3.1', and both the open slot 3.1' and the first regulating hole 2.3 are in coordinated connection through the regulating screw 6; a hole 3.2' is provided on the movable plate 3', a second regulating hole 2.4 is provided on the rotary arm 2 corresponding to the hole 3.2', and both the hole 3.2' and the second regulating hole 2.4 are in coordinated connection through the first eccentric regulating rivet 7'; Another hole 3.5' is also provided on the movable plate 3', a matching 9.1 is provided on the base plate 9 corresponding to the hole 3.5', and both the hole 3.5' and the matching hole 9.1 are in coordinated connection through the second eccentric regulating rivet 10. Both sides of the rotary arm 2 are bent downwards to form a slot 2.5 which is in limiting connection with the movable plate 3'; a boss 3.3' is provided on the movable plate 3' and is in coordinated connection with the rotary arm 2; the outside of the base plate 9 is bent towards to the direction of the movable plate 3' to form a guide slot 9.2, the movable plate 3' is slideably provided on the guide slot 9.2, and at least two corners of the base plate 9 are bent downwards to form a blocking part 9.3. A rectangle boss 3.6' is provided on the rear end of the movable plate 3', three sides of the boss 3.6' are torn and separated from the bottom surface of the movable plate 3', and only one side is remained and connected with the bottom surface, so thon the boss 3.6 has elasticity and thus can be inclined with the bottom surface by different angles under external force.

The rotary arm 2, the movable plate 3' and the base plate 9 are molded by integrated stamping and bending of metal.

The other parts which are not described are the same as those of the first embodiment.

The preferred embodiments of the present utility model are described above. All the simple modifications or transformations made by those skilled in the art to these embodiments fall within the claims of the present utility model.

It is claimed:

1. A blind hinge structure used for furniture, comprising a movable cup seat (1) provided on a furniture door body, a regulating base provided on a main body of furniture, a rotary arm connected between the movable cup seat (1) and the regulating base as well as an elastic member which is designed to generate start-stop acting force on the movable cup seat (1) at least, wherein an arm lever at a small end is hinged with the movable cup seat (1) through a pin shaft and forms an arc-shaped surface (2.1) which is connected with the elastic member; a top surface of a big end of the arm lever is a plane, regulating components are provided on the plane and are in coordinated connection with the regulating base wherein two boss steps (1.2) are provided at a bottom wall of the movable cup seat (1), wherein, the elastic element is two torsion springs respectively mounted on a notch (1.1) on both sides at the bottom of the movable cup seat (1), wherein each torsion spring (5) at least comprises a first supporting leg (5.1) with one end extending into the cup body of the movable cup seat (1) and being connected with it as well as a second supporting leg (5.2) with another end acting on the movable cup seat (1), wherein the free end of the second supporting leg (5.1) is bent, a step (1.2) is provided at the bottom wall of the movable cup seat (1) correspondingly, and the second supporting leg (5.2) is carried on the step (1.2), wherein a sleeve part (8) is provided on the first supporting leg (5.1), the first supporting leg (5.1) is in coordinated connection with the arc-shaped surface (2.1) through the sleeve part (8); the sleeve part (8) is in open sleeve form or closed sleeve form and is made from plastic or rubber, wherein the regulating base is a movable plate (3), the regulating components include a regulating screw (6) and an eccentric regulating rivet (7); the rotary arm (2) is connected with the movable plate (3) through the regulating screw (6) and the eccentric regulating rivet (7), so as to realize a two-dimensional regulation of the furniture door body; wherein one or more fasteners (4) are provided at the bottom of the movable plate (3) and are in coordinated positioning with the eccentric regulating rivet (7).

2. The blind hinge structure for furniture of claim 1, wherein, an open slot (3.1) is provided on a front end of the movable plate (3), a first regulating hole (2.3) is provided on the rotary arm (2) corresponding to the open slot (3.1), and both the open slot (3.1) and the first regulating hole (2.3) are in coordinated connection through regulating screw (6); a hole (3.2) is provided on the moveable plate (3), a second regulating hole (2.4) is provided on the rotary arm (2.2) corresponding to the hole (3.2), and both the hole (3.2) and the second regulating hole (2.4) are in coordinated connection through the eccentric regulating rivet (7).

3. The blind hinge structure used for furniture of claim 2, wherein, both sides of the rotary arm (2) are bent downwards to form a groove (2.5) which is in limiting connection with the movable plate (3), a boss (3.3) is provided on the movable plate (3) and is in coordinated connection with the rotary arm (2), at least two corners of movable plate (3) are bent downwards to form a claw (3.4).

4. The blind hinge structure used for furniture stated in claim 3, wherein, both the rotary arm (2) and the regulating base are molded by integrated stamping and bending of metal.

5. The blind hinge structure used for furniture stated in claim 2, wherein, both the rotary arm (2) and the regulating base are molded by integrated stamping and bending of metal.

6. The blind hinge structure used for furniture stated in claim 1, wherein, both the rotary arm (2) and the regulating base are molded by integrated stamping and bending of metal.

* * * * *